United States Patent [19]

Dechambeau et al.

[11] Patent Number: 4,966,217

[45] Date of Patent: Oct. 30, 1990

[54] SAFETY COVER FOR AUTOMOTIVE SERVICE PITS

[76] Inventors: Scott A. Dechambeau, 2105 Dorothy Ave., Boise, Id. 83706; Robert Torkelson, 542 Tyler Rd., Emmett, Id. 83617; David Thompson, 2209 Dorothy Ave. #2, Boise, Id. 83706

[21] Appl. No.: 309,165

[22] Filed: Feb. 13, 1989

[51] Int. Cl.[5] ..... E06B 9/26

[52] U.S. Cl. ..... 160/35; 160/118; 160/201

[58] Field of Search ..... 160/35, 118, 119, 201, 160/133; 52/169.7, 169.6; 292/289, 288, DIG. 46

[56] References Cited

U.S. PATENT DOCUMENTS

| | | | |
|---|---|---|---|
| 2,457,240 | 12/1948 | Jorgensen | 160/35 X |
| 3,280,888 | 10/1966 | Davis | 160/35 |
| 4,341,263 | 7/1982 | Eyerle | 160/133 |
| 4,628,646 | 12/1986 | Eyerle | 160/201 X |
| 4,662,420 | 5/1987 | Hirao | 160/133 X |

*Primary Examiner*—Blair M. Johnson

*Attorney, Agent, or Firm*—Frank J. Dykas; Craig M. Korfanta

[57] ABSTRACT

A safety cover 10 for automotive service pits 1 is constructed of square cross section hollow support members 11 welded to alternate links of double pitched roller chain segments 15. Cover 10 is divided into two halves wherein each half has support members 11 perpendicularly welded to two lengths of chain 15 at each end of support members 11. Support members 11 are further disposed in parallel spaced relation one to the other. Roller chain segments 15 are longitudinally supported at the top edges of the pit side walls 5 by opposing segments of C-channel 12. U-shaped bends 18 are provided in the lower lip 17 of opposing C-channel segments 12 and are disposed at, at least, one end which is adjacent an end wall 6 of automotive service pit 1. U-shaped bends 18 provide a receiving pocket for receiving the double pitched roller chain 15 and connecting support members 11 when cover 10 is slid into the open position.

C-channel 12 and double pitched roller chain 15 are constructed of suitable materials such that the relative coefficient of friction between roller chain 15 and C-channel 12 inhibits sliding of the cover with the addition of any weight, e.g. a person standing on the cover.

24 Claims, 6 Drawing Sheets

SAFETY COVER FOR AUTOMOTIVE SERVICE PITS

BACKGROUND OF THE INVENTION

1. Technical Field

This invention generally relates to safety covers for open pits and in particular it relates to safety covers for automotive service pits.

2. Background Art

Automotive service pits have become quite common in service stations, convenience lube shops, and the like. Non-coincidentally, the number of accidents resulting from uncovered pits has greatly increased.

Two solutions to this problem have been offered by the teachings of EYERLE, U.S. Pat. Nos. 4,341,253 and 4,628,646. Both of the devices consist of flexible bands of pivotally connected support members which are supported by a longitudinal guide rails attached to the top edges of the sides of the automotive service pit. Both the covers are electrically operated via an electric motor, sprocket and chains. Both patents teach the use of friction reducing devices for slidably supporting the support members within the longitudinal rails, thereby facilitating the sliding of the cover from the open to the closed position and vice versa.

The main difference between the two devices is that U.S. Pat. No. '253 teaches compressible support bars while U.S. Pat. No. '646 teaches non-compressible support bars supported by a guiding web structure which insures that the band is positively guided and cannot buckle even during its pushing motion, since the covers are both pushed and pulled by the electric drive means.

Several disadvantages are common to both the Eyerle devices. One disadvantage and safety liability is that both covers can be operated regardless of an object or person standing on the cover. In use, the covers are closed between the servicing of subsequent cars. The pitman remains in the service pit during the exchange of cars and does not always check to make sure that there is nothing on the cover before opening or closing it. Obviously this is a serious safety consideration.

Additionally, since the pitman remains in the pit while the cover is in the closed position, the devices effectively shade the pit from natural or outside illumination. This is a problem since most pit lighting was designed without this consideration. A further disadvantage to the pit covers taught by Eyerle are that they are both unnecessarily complicated and require excessive maintenance.

What is needed is a simplified pit cover which has a weight responsive brake means whereby the risk of operating the cover with a person or object standing on the cover is greatly reduced and further to provide a cover which allows ample illumination to the pit when the cover is in the closed position.

It is therefore an object of the present invention to provide a greatly simplified pit cover including a weight responsive brake means and spaced support members to provide adequate illumination to the automotive service pit.

DISCLOSURE OF INVENTION

These and other objects are accomplished by a safety cover for automotive service pits constructed of square cross section hollow support members welded to alternate links of double pitched roller chain segments. The cover is divided into two halves wherein each half has the support members perpendicularly welded at each end to two lengths of chain. The support members are further disposed in parallel spaced relation one to the other. The roller chain segments are slidably supported at the top edges of the pit side walls by opposing segments of "C" shaped channel. U-shaped bends are provided in the bottom lip in the ends of the opposing C-channel segments, adjacent the end walls of the automotive service pit. The U-shaped bends provide a receiving pocket for receiving the double pitched roller chain and connecting support members when the cover is slid into the open position.

Advantageously, the pit cover is divided into two halves, hence, there are receiving pockets on both ends of the automotive service pit. A pair of spring loaded detent latches are provided on each cover half and engage a detent hole or holes disposed in at least one C-channel segment, usually at the segment's mid point. This is an added safety feature to help prevent accidental opening of the pit cover.

In an alternative embodiment, the cover is simply one piece and has only one elongated U-shaped receiving pocket in one end of the opposing C-channel segments, for receiving the entire cover when in the open position.

In both embodiments the C-channel and double pitched roller chain are constructed of suitable materials such that the relative coefficient of friction between the roller chain and C-channel inhibits sliding of the cover with the addition of any weight, e.g. a person standing on the cover.

BEST MODE FOR CARRYING OUT INVENTION

Figure 1:
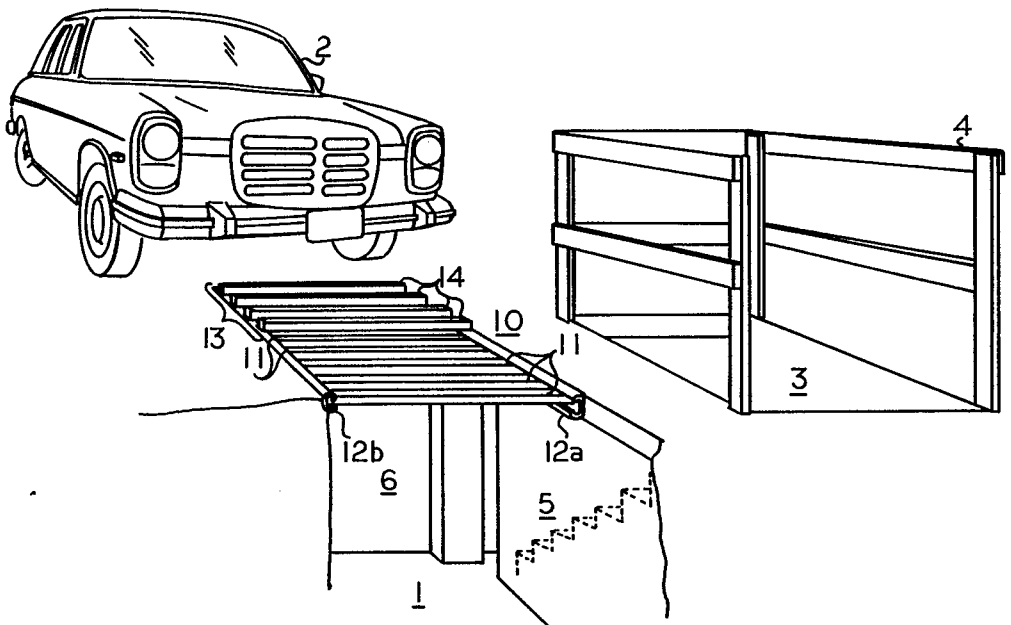
FIG. 1 is a cut-away view of an automotive service bay having a service pit and safety cover therein.

FIG. 1 shows a typical automotive service bay having an automotive service or grease pit 1 therein. In use, an automobile 2 straddles grease pit 1 for servicing. A grease pitman accesses grease pit 1 via grease pit entrance 3 which has safety railing 4 surrounding it. Obviously, it is impractical to provide a safety railing around grease pit 1, such as safety railing 4.

Accordingly, the present invention, safety cover 10, provides a slidable safety cover for grease pit 1, which when closed will support the full weight of a person standing on it, and when open, is conveniently stored out of the pitman's way.

Figure 2:
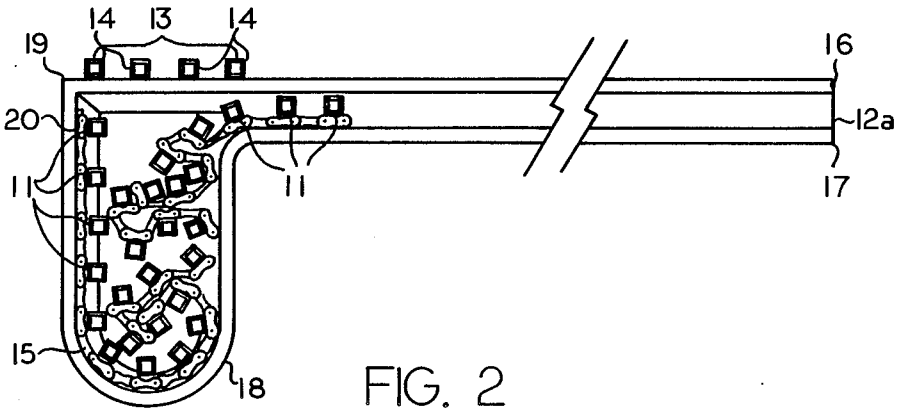
FIG. 2 is a sectional end view of the automotive service pit safety cover taken along the longitudinal centerline.

Referring also now to FIG. 2, safety cover 10 is constructed from C-channel 12, double pitched roller chain 15 and transverse bar members 11. Transverse bar members 11 are welded to alternate links of two parallel segments of roller chain 15. The segments of roller chain 15 each have a length at least as great as the length of grease pit 1, as defined by side walls 5, for the one piece cover embodiment. Transverse bar members 11 each have a length slightly less than that of end walls 6. Two opposing C-channel segments, 12*a* and 12*b*, are attached along the upper edge of opposing side walls 5 for receiving the parallel segments of roller chain 15 and attached transverse bar members 11.

Figure 3B:
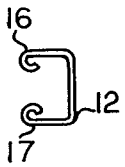
FIG. 3*b* is a sectional end view taken along section line A of FIG. 3*a*.
Figure 3A:
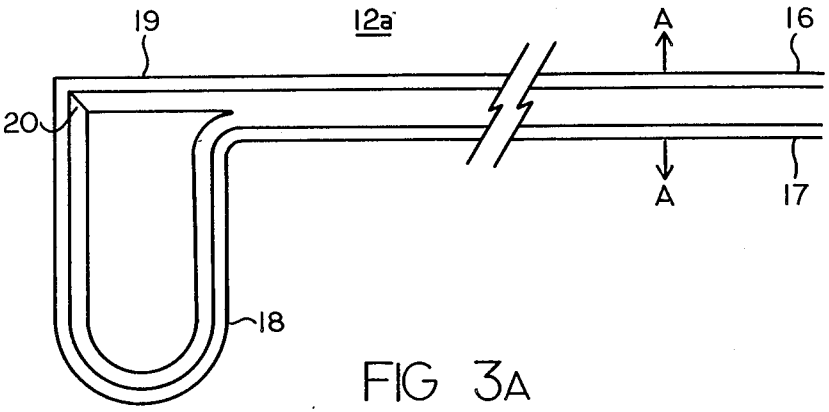
FIG. 3*a* is a side view of a C-channel segment having a U-shaped receiving pocket at one end.

FIGS. 2, 3*a* and 3*b*, clearly show a configuration of one of the opposing C-channel segments 12*a* of opposing pair 12*a* and 12*b*. C-channel segment 12*b* is a mirror image of C-channel segment 12*a*. C-channel segment 12*a* has lower lip 17 having a U-shaped bend 18 in one end, here shown at the left most end. The left most end of lower lip 17 is attached to an extending portion, here designated as longitudinal grate member 19, of upper lip 16. The joint of extending portion 19 of upper lip 16 with U-shaped bend 18, additionally provides an attachment point 20 for one of the segments of roller chain 15. The U-shaped bends 18 in both C-channel segments 12*a* and 12*b* together form a receiving pocket which acts as a gravity catcher for transverse bar members 11 and parallel segments of roller chain 15. U-shaped bends 18 can be detachable to facilitate removal and replacement of transverse bar members 11 and parallel segments of roller chain 15.

C-channel segments 12*a* and 12*b* and roller chain 15 are each manufactured from a suitable material such that the relative coefficient of friction, between C-channel 12 and roller chain 15, frictionally inhibits sliding of safety cover 10, when and if, any additional weight is placed on transverse bar members 11. In this particular embodiment, C-channel 12 is a cold formed channel having an electrogalvanized finish, while double pitch roller chain 15 is manufactured of case hardened steel and transverse bar members are hollow steel tubes having a square cross section. Obviously, the force required to slide the cover is a function of the relative coefficient of friction and the applied weight, including the weight of roller chain 15 and transverse bar members 11.

A receiving pocket grate 13 is provided at the receiving pocket end of C-channel segments 12*a* and 12*b*. Receiving pocket grate 13 has grate bar members 14, which are in this particular embodiment, identical to transverse bar members 11, attached in parallel spaced relation to longitudinal grate members 19.

Figure 4:
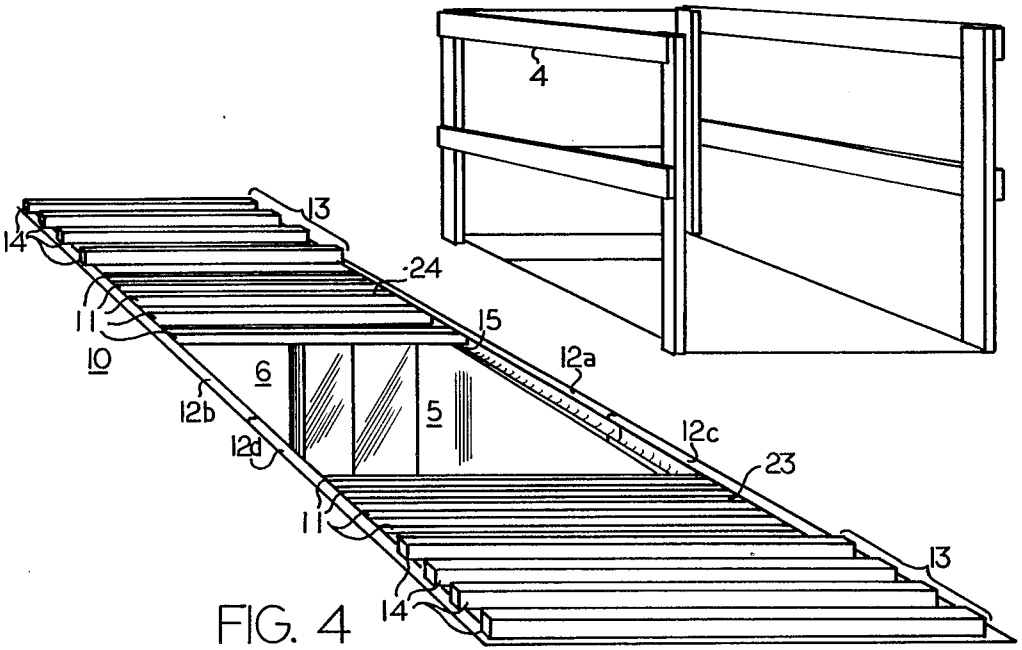
FIG. 4 is a representational view of a safety cover having two halves.
Figure 5:
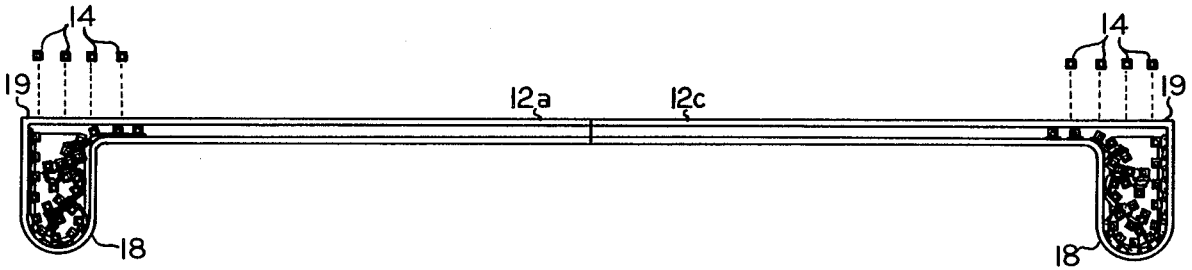
FIG. 5 is a partially exploded sectional end view of the automotive service pit safety cover having two halves taken along the longitudinal centerline.
Figure 6:
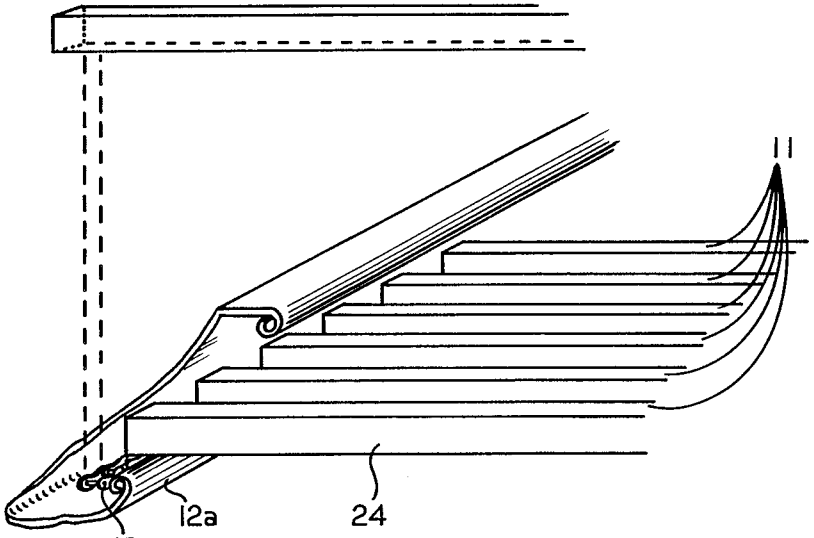
FIG. 6 is a partially exploded view of a safety cover, showing a detent latching mechanism.

Referring now to FIGS. 4, 5 and 6, a second preferred embodiment of safety cover 10 is shown which includes a two-part cover. The second embodiment has transverse bar members 11 attached to two pairs of parallel segments of roller chain 15. Each pair of parallel segments of roller chain 15 are slidably engaged with opposing pairs of C-channel segments, 12*a* and 12*b*, and 12*c* and 12*d*. The second pair of opposing C-channel segments 12*c* and 12*d* are configured identically to the first pair, 12*a* and 12*b*. C-channel segments 12*a* and 12*c* are attached at their unbent ends to form a single C-channel segment having U-shaped bends 18 at both ends. C-channel segments 12*b* and 12*d* are identically configured. This second embodiment provides a safety cover 10 which has two halves 23 and 24 opening and closing from and to the mid point, i.e. the joint of C-channel segments 12*a* and 12*c*. Receiving pockets are provided in both ends.

Receiving pocket grates 13 are provided at both ends of automotive grease pit 1. Receiving pocket grates 13 have grate bar members 14, which in this particular embodiment are identical to transverse bar members 11, attached in parallel spaced relation to longitudinal grate members 19.

Referring specifically now to FIG. 6, detent latches 21 are provided to the second end of the safety cover halves 23 and 24, of which 24 is shown, to engage detent notch or notches 22 disposed within C-channel segments 12. Alternatively, a standard latching mechanism could be used in lieu of detent latches 21. For example, the end transverse bar member could be configured to drop into detent notch 22.

In use the pitman closes safety cover 10 upon the completion of servicing automobile 1. Safety cover 10 remains closed during the exchange of automobiles and is opened only after the next automobile is in the servicing position. During the time when an automobile is not straddling the service pit, safety cover 10 cannot be opened by an inattentive pitman if someone is standing or resting on the cover.

While there is shown and described the present preferred embodiment of the invention, it is to be distinctly understood that this invention is not limited thereto but may be variously embodied to practice within the scope of the following claims.

We claim:

1. A safety cover for an automotive service pit having a pair of side walls defining the longitudinal dimension and a pair of end walls defining the transverse dimension, which comprises:

first and second segments of roller chain each having a length approximately equal to the longitudinal dimension of the automotive service pit and disposed in parallel spaced relationship one to the other;

a plurality of bar members each having a first end perpendicularly attached to said first segment of roller chain and a second end perpendicularly attached to said second segment of roller chain, said bar members further being disposed in parallel spaced relation one to the other and having a length approximately equal to the inside transverse dimension of the automotive service pit;

first and second segments of C-channel each having a length at least as great as the longitudinal dimension of the automotive service pit, said first C-channel segment being attached along the top edge of a first side of said pair of side walls for slidably and frictionally receiving said first roller chain segment, and said second C-channel segment being attached along the top edge of a second side of said pair of side walls for slidably and frictionally receiving said second roller chain segment;

each of said C-channel segments further having upper and lower lips for holding said roller chain with a U-shaped bend in one end of the lower lip forming a receiving pocket adjacent an end wall of the automotive service pit for receiving said bar members and connected roller chain segments when the cover is in an open position; and weight responsive brake means for inhibiting sliding of the cover when weight is placed on any one or more of said plurality of bar members.

2. The safety cover of claim 1 wherein said weight responsive brake means comprises constructing said roller chain segments and said C-channel segments from suitable materials such that the relative coefficient of friction between the roller chain and C-channel inhibits sliding when weight is placed on any one or more of said plurality of bar members.

3. The service pit safety cover of claim 2 wherein the parallel spaced disposition of said bar members is such that sufficient light passes through the spaces between the bar members to illuminate the service pit when covered.

4. The service pit safety cover of claim 3 wherein said bar members are load bearing elongated hollow tubes having a square cross section.

5. The service pit safety cover of claim 4 wherein said roller chain is constructed of case hardened steel and said C-channel is constructed of electrogalvanized coated cold formed steel.

6. The service pit safety cover of claim 3 wherein said roller chain is constructed of case hardened steel and said C-channel is constructed of electrogalvanized coated cold formed steel.

7. The service pit safety cover of claim 2 wherein said roller chain is constructed of case hardened steel and said C-channel is constructed of electrogalvanized coated cold formed steel.

8. The service pit safety cover of claim 2 wherein said bar members are load bearing elongated hollow tubes having a square cross section.

9. The service pit safety cover of claim 8 further comprising a receiving pocket grate having a plurality of grate bar members perpendicularly attached at a first end to a first longitudinal grate member and at a second end to a second longitudinal grate member, said longitudinal grate members being attached to opposing sides of the automotive service pit and spanning the U-shaped bends in the C-channel and said plurality of grate bar members being disposed in parallel spaced relation thereby forming a stationary cover for the receiving pocket.

10. The service pit safety cover of claim 1 wherein the parallel spaced disposition of said bar members is such that sufficient light passes through the spaces between the bar members to illuminate the service pit when covered.

11. The service pit safety cover of claim 10 wherein said bar members are load bearing elongated hollow tubes having a square cross section.

12. The service pit safety cover of claim 11 wherein said roller chain is constructed of case hardened steel and said C-channel is constructed of electrogalvanized coated cold formed steel.

13. The service pit safety cover of claim 12 wherein said roller chain is constructed of case hardened steel and said C-channel is constructed of electrogalvanized coated cold formed steel.

14. The service pit safety cover of claim 13 wherein said roller chain is constructed of case hardened steel and said C-channel is constructed of electrogalvanized coated cold formed steel.

15. The service pit safety cover of claim 14 wherein said bar members are load bearing elongated hollow tubes having a square cross section.

16. The service pit safety cover of claim 15 further comprising a receiving pocket grate having a plurality of grate bar members perpendicularly attached at a first end to a first longitudinal grate member and at a second end to a second longitudinal grate member, said longitudinal grate members being attached to opposing sides of the automotive service pit and spanning the U-shaped bends in the C-channel and said plurality of grate bar members being disposed in parallel spaced relation thereby forming a stationary cover for the receiving pocket.

17. A safety cover for automotive service pits having a pair of side walls defining the longitudinal dimension and a pair of end walls defining the transverse dimension, which comprises:

first, second, third and fourth segments of roller chain each having a length approximately equal to one half the longitudinal dimension of the automotive service pit and disposed in pairs in parallel spaced relationship;

a first plurality of bar members each having a first end perpendicularly attached to said first segment of roller chain and a second end perpendicularly attached to said second segment of roller chain thereby defining a first half of the safety cover, said bar members further being disposed in parallel spaced relation one to the other and having a length approximately equal to the inside transverse dimension of the automotive service pit;

a second plurality of bar members each having a first end perpendicularly attached to said third segment of roller chain and a second end perpendicularly attached to said fourth segment of roller chain thereby defining a second half of the safety cover, said bar members further being disposed in parallel spaced relation one to the other and having a length approximately equal to the inside transverse dimension of the automotive service pit;

first, second, third and fourth segments of C-channel each having a length at least as great as one half the longitudinal dimension of the automotive service pit, said first and third C-channel segments being attached end to end and along the top edge of a first side of said pair of side walls for slidably and frictionally receiving said first and third roller chain segments respectively, and said second and fourth C-channel segments being attached end to end and along the top edge of a second side of said pair of side walls for slidably and frictionally receiving said second and fourth roller chain segments, respectively;

each of said C-channel segments further having upper and lower lips for holding said roller chain with a U-shaped bend in one end of the lower lip forming a receiving pocket adjacent an end wall of the automotive service pit for receiving said bar members and connected roller chain segments when the cover is in an open position;

said safety cover first half being attached at a first end to the ends of said first and second C-channel segments adjacent an end wall and said safety second half being attached at a first end to the ends of said third and fourth C-channel segments adjacent the other end wall; and weight responsive brake means having said roller chain segments and said C-channel segments each being constructed from suitable materials such that the relative coefficient of friction between the roller chain and the C-channel inhibits sliding when additional weight is placed on any one or more of said plurality of bar members.

18. The service pit safety cover of claim 17 wherein the parallel spaced disposition of said bar members is such that sufficient light passes through the spaces between the bar members to illuminate the service pit when covered.

19. The service pit safety cover of claim 18 wherein said bar members are load bearing elongated hollow tubes having a square cross section.

20. The service pit safety cover of claim 19 wherein said roller chain is constructed of case hardened steel and said C-channel is constructed of electrogalvanized coated cold formed steel.

21. The service pit safety cover of claim 18 wherein said roller chain is constructed of case hardened steel and said C-channel is constructed of electrogalvanized coated cold formed steel.

22. The service pit safety cover of claim 17 wherein said roller chain is constructed of case hardened steel and said C-channel is constructed of electrogalvanized coated cold formed steel.

23. The service pit safety cover of claim 17 wherein said bar members are load bearing elongated hollow tubes having a square cross section.

24. The service pit safety cover of claim 23 further comprising a pair of receiving pocket grates each having a plurality of grate bar members perpendicularly attached at a first end to a first longitudinal grate member and at a second end to a second longitudinal grate member, said longitudinal grate members being attached to opposing sides of the automotive service pit and spanning the U-shaped bends in the C-channel and said plurality of grate bar members being disposed in parallel spaced relation thereby forming a stationary cover for the receiving pocket.

* * * * *